US006752073B1

(12) United States Patent
Paris

(10) Patent No.: US 6,752,073 B1
(45) Date of Patent: Jun. 22, 2004

(54) BUNDLER METHOD AND APPARATUS

(76) Inventor: Raymond Paris, 10750 Aaron Dr., Parma, OH (US) 44130

( * ) Notice: Subject to any disclaimer, the term of this patent is extended or adjusted under 35 U.S.C. 154(b) by 0 days.

(21) Appl. No.: 10/444,017

(22) Filed: May 22, 2003

Related U.S. Application Data

(62) Division of application No. 09/619,297, filed on Jul. 19, 2000, now Pat. No. 6,588,329.
(60) Provisional application No. 60/144,690, filed on Jul. 20, 1999.

(51) Int. Cl.[7] ..... B30B 5/04
(52) U.S. Cl. ..... 100/212; 100/3; 100/7; 414/745.1
(58) Field of Search ..... 100/212, 3, 5, 100/7, 87; 53/148, 215; 414/745.1, 746.4

(56) References Cited

U.S. PATENT DOCUMENTS

| | | | | |
|---|---|---|---|---|
| 306,729 A | * | 10/1884 | Elder | 100/212 |
| 987,740 A | * | 3/1911 | Peterman | 100/212 |
| 3,168,032 A | | 2/1965 | Faulkner | |
| 3,262,246 A | | 7/1966 | Olsen et al. | |
| 3,427,958 A | | 2/1969 | Glasson | |
| 3,427,959 A | | 2/1969 | Keil | |
| 3,627,300 A | | 12/1971 | Caveney et al. | |
| 3,871,288 A | | 3/1975 | White | |
| 3,941,639 A | * | 3/1976 | Maroschak | 156/207 |
| 3,956,982 A | | 5/1976 | Hill et al. | |
| 4,120,406 A | | 10/1978 | Durnig | |
| 4,141,289 A | * | 2/1979 | Blagov et al. | 100/212 |
| 4,174,662 A | | 11/1979 | Klusmier | |
| 5,387,072 A | | 2/1995 | Gepfert et al. | |
| 6,588,329 B1 | * | 7/2003 | Paris | 100/3 |

FOREIGN PATENT DOCUMENTS

GB 1358472 7/1974

OTHER PUBLICATIONS

Automatic Tube Bundling & Packaging System—Thermatool (Date Unknown).
Automatic Packaging Lines—Mair Research (Date Unknown).

* cited by examiner

*Primary Examiner*—Stephen F. Gerrity
*Assistant Examiner*—Thanh Truong
(74) *Attorney, Agent, or Firm*—Fay, Sharpe, Fagan, Minnich & McKee, LLP

(57) ABSTRACT

An improved bundling method and apparatus is provided for receiving, forming, and holding a desired shape for the bundling of cylindrical objects of various materials through the use of a set of movable links. The method and apparatus use a series of interconnected, predefined lengths of jointed members or links to complete the process of receiving, shaping, and holding a bundle of cylindrical objects in a polygon shaped cross-section such that banding can be applied to the bundle.

10 Claims, 12 Drawing Sheets

BUNDLER METHOD AND APPARATUS

This application is a divisional application of U.S. application Ser. No. 09/619,297 filed Jul. 19, 2000, now U.S. Pat. No. 6,588,329, which claims benefit of the filing date of U.S. provisional application Ser. No. 60/144,690, filed on Jul. 20, 1999.

BACKGROUND OF THE INVENTION

1. Field of the Invention

The present invention relates to forming elongated materials in a desired shape for shipping and/or storage, and more particularly, to an improved bundling method and apparatus. The present invention finds particular application in conjunction with the bundling of cylindrical or nearly cylindrical object (e.g., elongated ovalized objects or polygonal objects with greater than 4 sides), and it is described herein with particular reference to cylindrical objects. It is to be appreciated, however, that the present invention is also amenable to other applications.

2. Discussion of the Art

Bundling methods and apparatus have been used for many years to produce various bundled shapes from a plurality of elongated cylindrical or nearly cylindrical objects. The cylindrical objects are loaded onto a machine and bundled for shipping. Various shapes of bundles have been used and various numbers of cylindrical objects have been included in the bundles. However, prior art bundling methods and apparatus have been replete with problems.

One such prior art method involves dumping cylindrical objects onto loosened flexible straps or the like. The straps are then tightened to form a substantially round bundle. This method is problematic because the round bundles formed are not of a uniform dimensions which causes problems in the stacking and shipping of the bundles. Further, the bundles tend to loosen during shipping.

Another prior method involves counting and conveying cylindrical objects to an apparatus which then lifts each cylindrical object with a set of carrying arms. Each cylindrical object is then placed in a designated position to form a hexagonal bundle. This method reduces the problems associated with bundles of varying shapes and varying numbers of cylindrical objects. However, a substantial amount of time is required to form each bundle, and the mechanism is very complex.

Another prior art method involves dumping or rolling cylindrical objects into a pre-formed bottom portion of a hexagon or other polygon frame. Once the bottom half portion of the hexagon bundle is formed in the half-hexagonal frame, the remainder of the bundle is formed manually by placing the cylindrical objects one by one. This method reduces the overall amount of time required to form each bundle but a significant amount of time and manual labor is still required to form the top portion of each bundle. Furthermore, this operation can be dangerous to those involved in the manual bundle forming process.

Another prior art method involves lifting the cylindrical objects using electromagnets. The bundles are capable of being formed one layer at a time. Bundling in this manner decreases the amount of time required to form each bundle and ensures a uniformly shaped bundle and a uniform number of cylindrical objects in each bundle. Nonetheless, the time required to form each bundle is sub-optimal. Further, the cylindrical objects may only be made of ferrous materials. Thus, cylindrical objects made of non-ferrous materials (e.g., copper tubes) are not capable of being lifted by magnetic systems.

Therefore, it is desirable to provide an improved bundling method and apparatus that overcomes these problems and others, while providing more advantageous overall results.

BRIEF SUMMARY OF THE INVENTION

In accordance with the present invention, an improved bundling method and apparatus is provided for minimizing the above mentioned and other disadvantages of the prior art. The improved method and apparatus are associated with receiving, forming, and holding a desired shape for the bundling of cylindrical objects of various materials through the use of a set of movable links.

The method and apparatus of the present invention use, in a preferred embodiment, a series of interconnected, predefined lengths of jointed members or links to complete the process of receiving, shaping, and holding a bundle of cylindrical objects in a polygon shaped cross-section such that banding can be applied to the bundle.

A main advantage of the present invention resides in the provision of a method and apparatus for bundling multiple elongated objects such as cylindrical objects using one or more sets of interconnected links that move between first and second operative positions. The first position is a loading position where the links are stretched out to receive the objects. The second position is a bundling position wherein the opposite ends of the set of interconnected links are moved adjacent to each other so that the objects shift into the desired polygonal shape, with the flat portions of the bundled objects lying respectively adjacent the links. Of course, the number of links is related to the number of flats on the resulting bundle, with the length of each flat roughly corresponding to the length of each link.

Another primary advantage of the present invention is the provision of an improved bundling method and apparatus that requires the minimum amount of repetitive motion to bundle a group of cylindrical objects.

A further advantage of the present invention is the provision of an improved bundling method and apparatus that increases the speed at which a bundle may be formed.

Another advantage of the present invention over the prior art is the provision of an improved bundling method and apparatus that may be used on ferrous and non-ferrous materials.

Still another advantage of the present invention is the provision of an improved bundling method and apparatus that builds bundles in a manner that is not laborious or dangerous.

Another advantage of the present invention is the provision of an improved bundling method and apparatus that may be used to create bundles of varying predetermined polygonal shapes when desired.

Still other features and benefits of the invention will be apparent to those skilled in the art upon reading and understanding the following detailed description.

BRIEF DESCRIPTION OF THE DRAWINGS

The structure, operation and advantages of the preferred embodiments of this invention will become further apparent upon consideration of the following description, taken in conjunction with the accompanying drawings. Of course, the drawings are only for purposes of illustrating preferred embodiments and are not to be construed as limiting the invention.

DETAILED DESCRIPTION OF THE INVENTION

Figure 1:
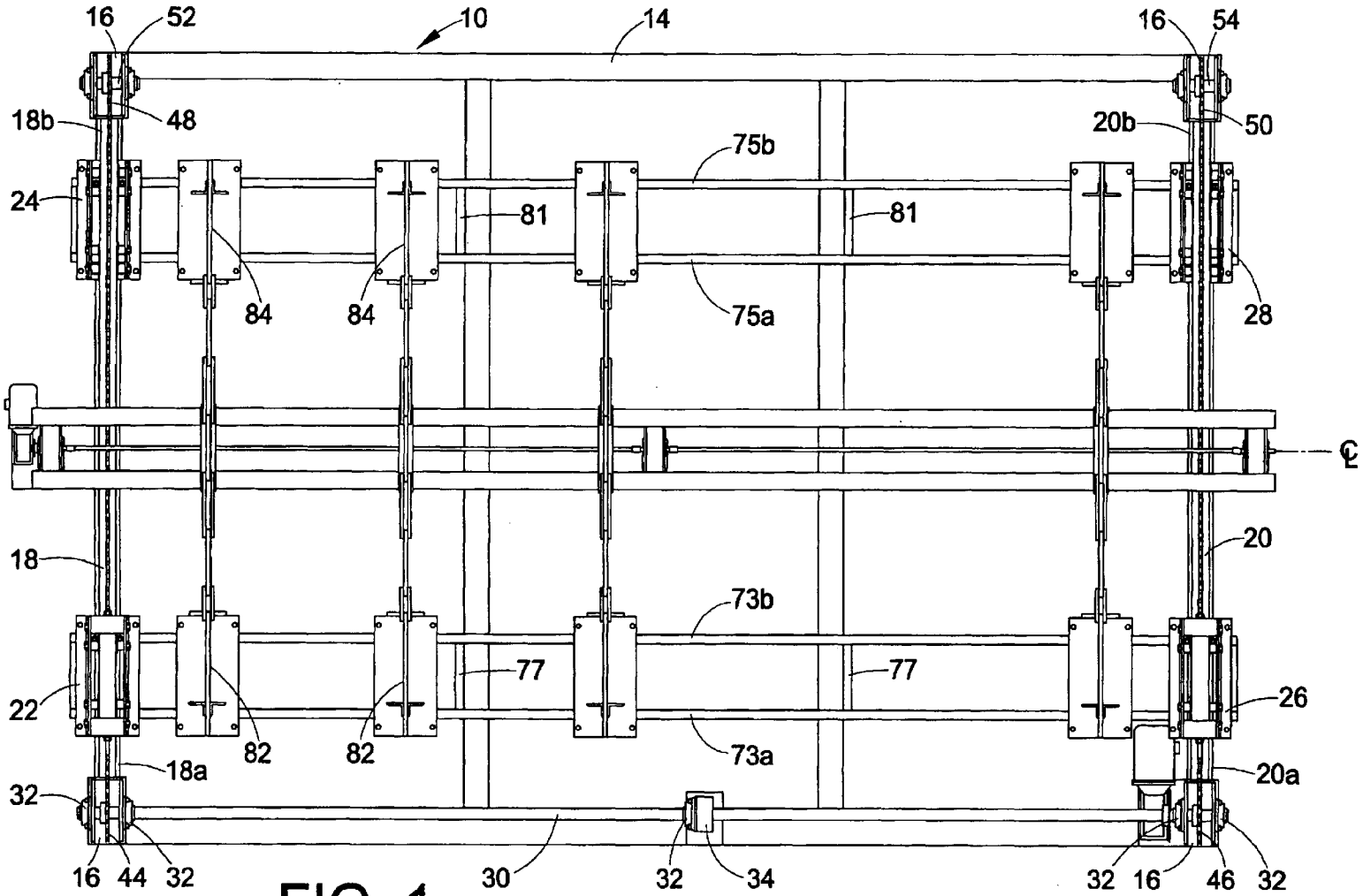
FIG. 1 is a plan view of a bundler apparatus shown in a first or unbundled position in accordance with the present invention.

Referring now to the drawings wherein like reference characters represent like elements, the showings are for purposes of illustrating preferred embodiments of the invention only and not for purposes of limiting the same. An improved method and apparatus is provided for receiving, forming, and holding a desired shape for the bundling of cylindrical or nearly cylindrical elongated objects of various materials through the use of links.

Figure 2:
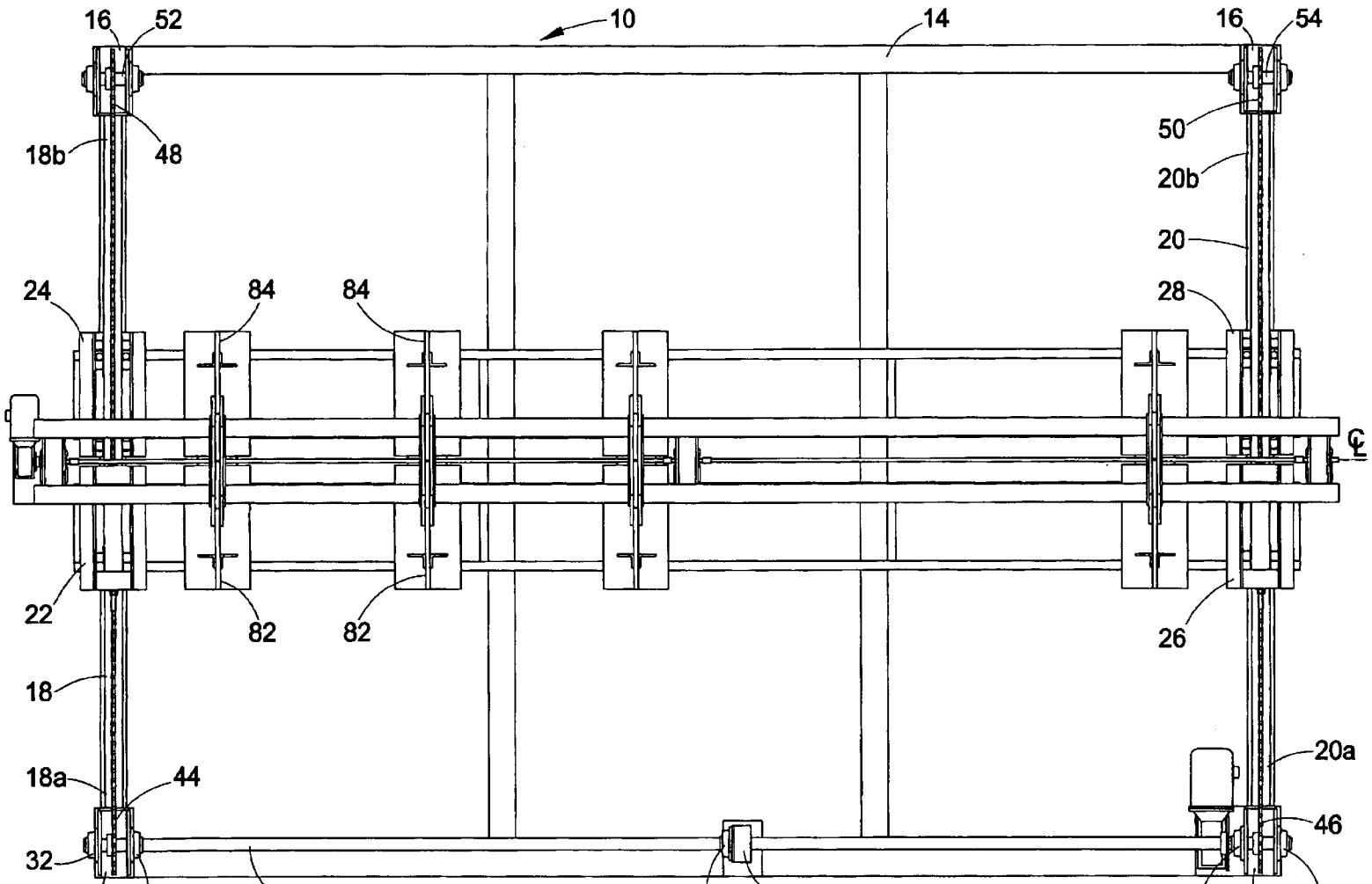
FIG. 2 is a plan view of a bundler apparatus shown in a second or bundled position in accordance with the present invention.
Figure 3:
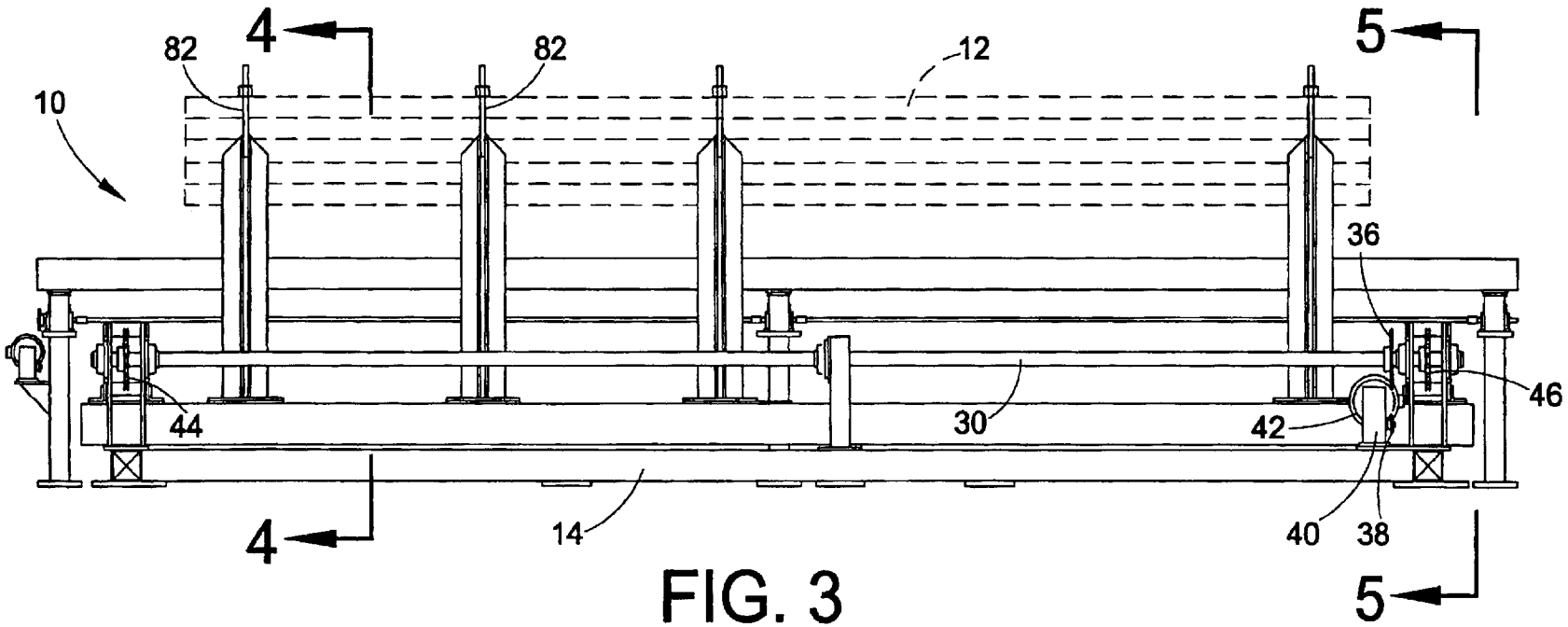
FIG. 3 is a side elevational view of a bundler apparatus formed in accordance with the present invention.

With reference to FIG. 1–FIG. 3, a bundler apparatus 10 is shown for securing and bundling cylindrical or like objects 12 (FIG. 3) according to a first preferred embodiment of the present invention. The apparatus 10 includes a frame 14 having a plurality of vertical support plates 16 for securing first and second truck beams 18 and 20. The bundling material 12 is, upon being loaded onto the apparatus, positioned perpendicularly relative to the first and second truck beams 18 and 20. Slidably or otherwise movably contained to or positioned on the first truck beam 18 is a first set of trucks including a drive truck 22 and an idle truck 24. Likewise, a second set of trucks, axially spaced-apart from the first set and including drive truck 26 and idle truck 28, is slidably or movably contained to or positioned on the second truck beam 20.

A drive shaft 30 is rotatably mounted between sets of flange bearings 32 disposed on the vertical support plates 16. The drive shaft 30 extends between the truck beams 18 and 20 and is positioned at or near their respective drive ends 18*a* and 20*a*. The shaft 30 is additionally supported by another flange bearing 32 disposed on a support arm 34 extending from the frame 14. With specific reference to FIG. 3, a drive sprocket 36 is mounted to the shaft 30 which is connected to a motor sprocket 38 of a motor 40 by a chain means 42.

With continued reference to FIGS. 1–3, drive end sprockets 44 and 46 are disposed one each at the distal ends of the shaft 30. At idle ends 18*b* and 20*b*, idle end sprockets 48 and 50 are mounted to stub shafts 52 and 54 which are rotatably mounted to the vertical support plates 16 supporting the idle ends 18*b* and 20*b*.

Figure 4:
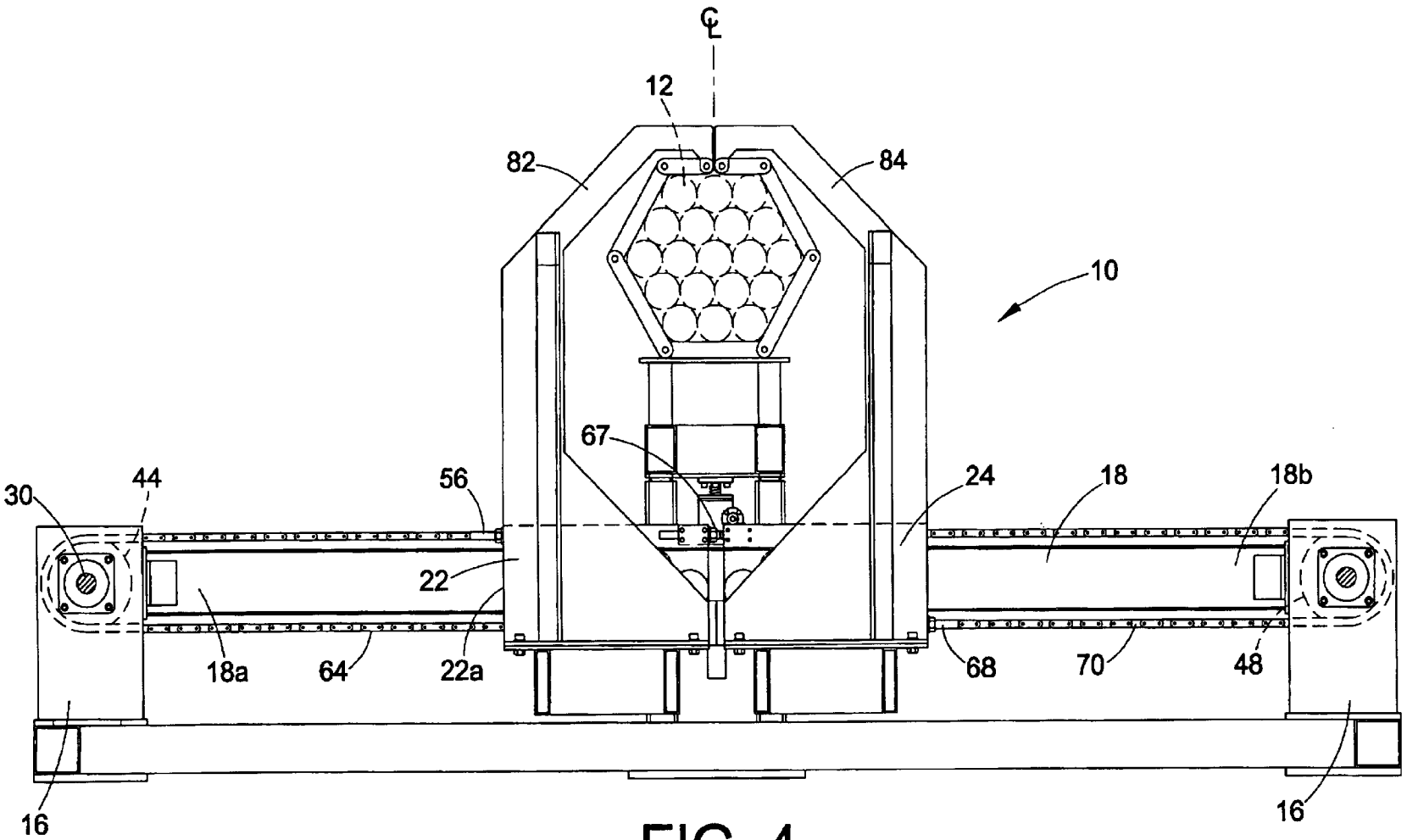
FIG. 4 is a cross-sectional end view of the bundler apparatus taken along line 4—4 of FIG. 3.
Figure 5:
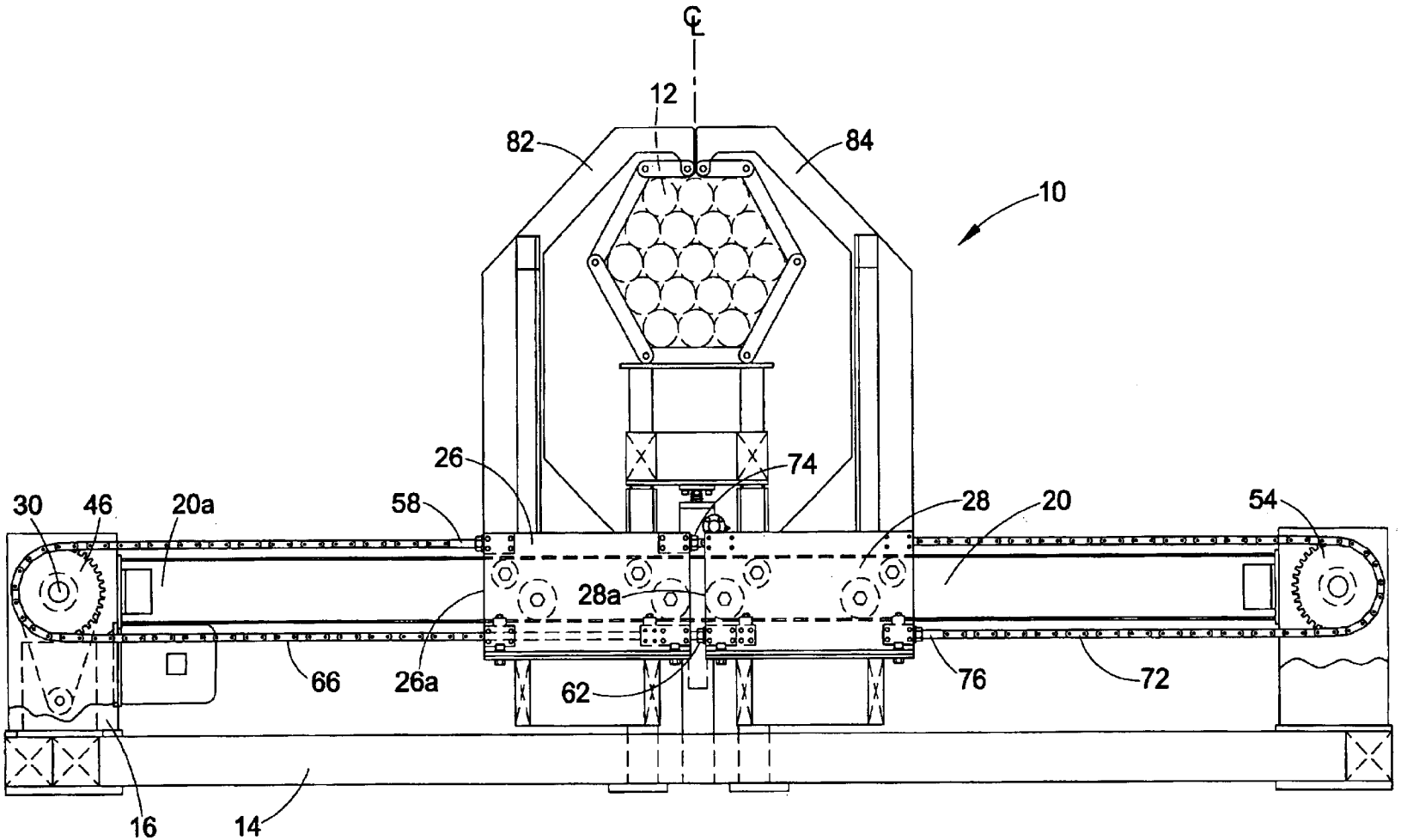
FIG. 5 is a cross-sectional end view of the bundler apparatus taken along line 5—5 of FIG. 3.

With additional reference to FIGS. 4 and 5, drive trucks 22 and 26, disposed on opposite truck beams 18 and 20, include upper swing bolts 56 and 58 located on the upper sides of truck drive ends 22*a* and 26*a*. Idle trucks 24 and 28, also disposed on opposite truck beams 18 and 20, include lower swing bolts 60 (not shown) and 62 located on the lower sides of truck drive ends 24*a* and 28*a*. A first drive chain 64 interconnects drive truck 22 to idle truck, 24 attaching to swing bolts 56 and 60. One end of the chain 64 attaches to swing bolt 56. From the swing bolt 56, the chain 64 engages and wraps around sprocket 44, passes through or adjacent to the drive truck 22, and attaches to swing bolt 60. In a like manner, a second drive chain 66 interconnects drive truck 26 to idle truck 28 attaching to swing bolts 58 and 62. The chain 66 engages drive sprocket 46 and passes through or adjacent to the drive truck 26. Swing bolts 56–62 may be used to synchronize the associated trucks and to adjust tension on their respective chains 64 and 66.

Additional swing bolts 67 and 68 provide an attaching means for first idle chain 70 to further interconnect drive truck 22 to idle truck 24. The chain 70 attaches to swing bolt 67 at one end and swing bolt 68 at another end. The chain 70 passes through or adjacent to idle truck 24 and engagingly around idle sprocket 48. In a like manner, second idle chain 72 further interconnects drive truck 26 to idle truck 28 by attaching to swing bolts 74 and 76. The second idle chain 72 passes through or adjacent to idle truck 28 and engagingly around idle sprocket 54. Again, swing bolts 67–76 allow synchronization of the associated trucks and tension adjustments on their respective chains 70 and 72.

With reference back to FIGS. 1 and 2, drive side longitudinal members 73*a*,73*b* are disposed between first trucks 22 and 26 and perpendicular to truck beams 18 and 20. These members 73*a*,73*b* are connected by cross members 77. Likewise, idle side longitudinal members 75*a*,75*b* are disposed between second trucks 24 and 28 perpendicular to truck beams 18 and 20 with cross members 81 therebetween. With reference again to FIG. 1, a plurality of opposing link arms 82 and 84 are disposed along the length of the longitudinal members 73*a*,73*b* and 75*a*,75*b*. The link arms 82 and 84 extend upward relative to the longitudinal members.

Figure 6:
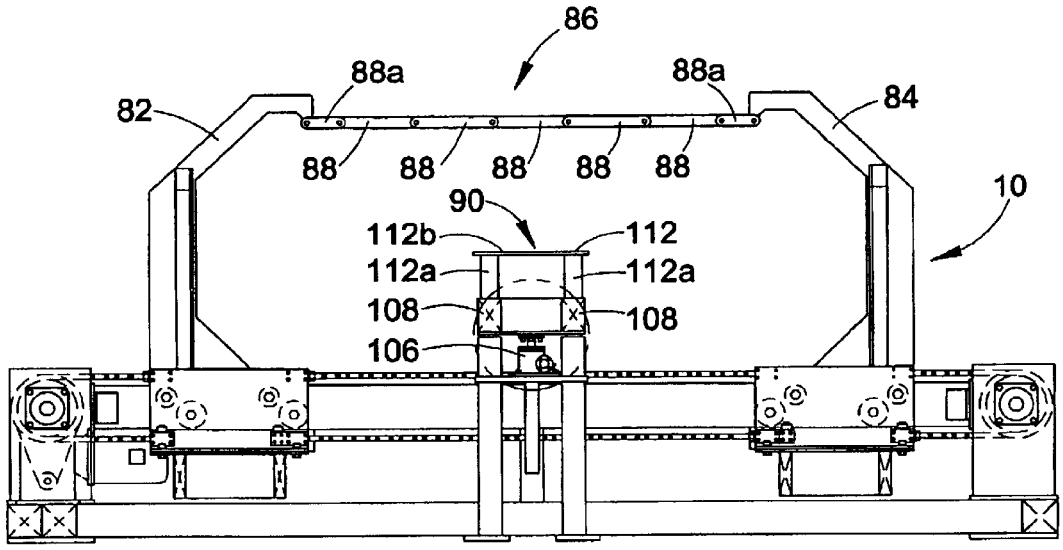
FIG. 6 is an end view of the bundler apparatus in accordance with the present invention.

With continued reference to FIGS. 1–5 and specific reference to FIG. 6, a set of link members 86 is disposed between each set of opposing link arms 82 and 84. In the illustrated embodiment, the set of link members 86 includes five individual (preferably identical) primary link members 88 pivotally attached to one another in an end-to-end arrangement with two shorter end or secondary link members 88*a* located on respective opposite ends of the group of primary link members and used for attaching the set of primary link members 88 to link arms 82 and 84. The secondary link members 88*a* are, themselves, pivotally connected to the adjacent primary link member 88 and also to the adjacent arms 82 and 84. The secondary link members 88*a* are each preferably approximately ½ the length of the primary link members 88, and the two secondary link members can, if desired, be replaced with a single link member 88. The illustrated arrangement of link members 88 is optimal for forming a hexagonal shaped bundle of material 12. Of course, it should be appreciated that the length and number of link members 88 may be varied and any polygonal shaped bundle of material 12 can be formed in accordance with the present invention. As will become apparent upon reading the following disclosure, the number of links 88,88*a* is directly related to the number of flats on the resulting bundle of objects 12, and the length of the links is directly related to the length of these flats.

Figure 6A:
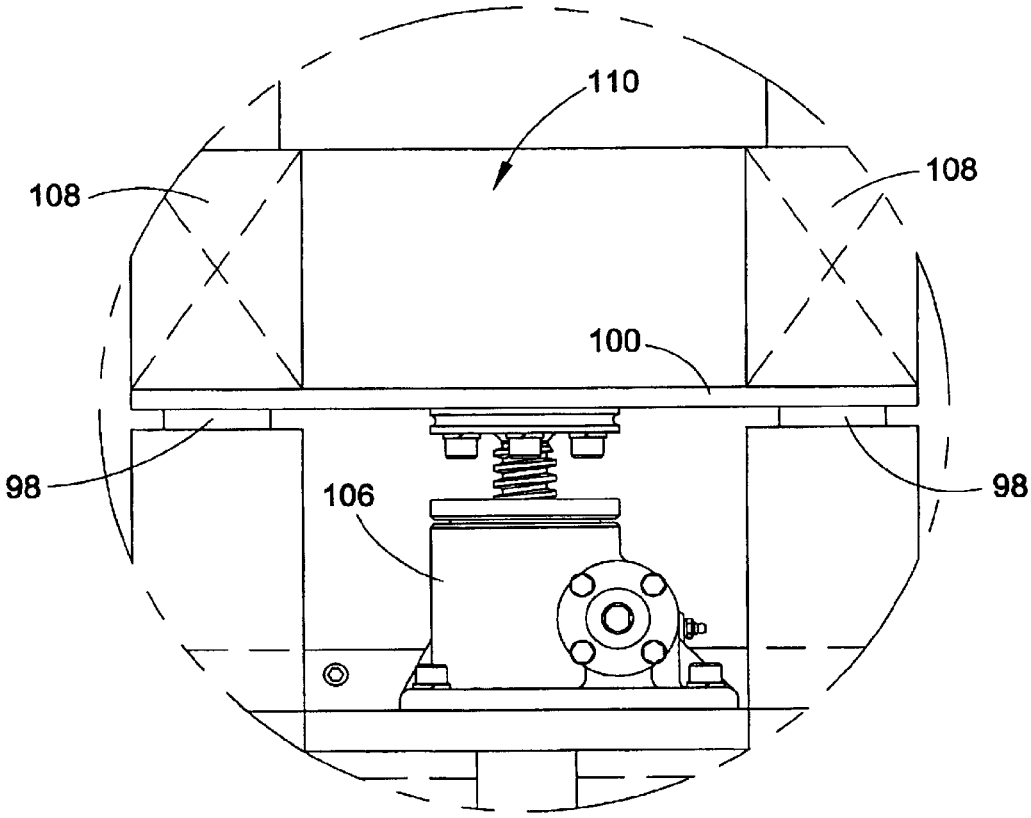
FIG. 6*a* illustrates an enlarged portion of FIG. 6.
Figure 7:
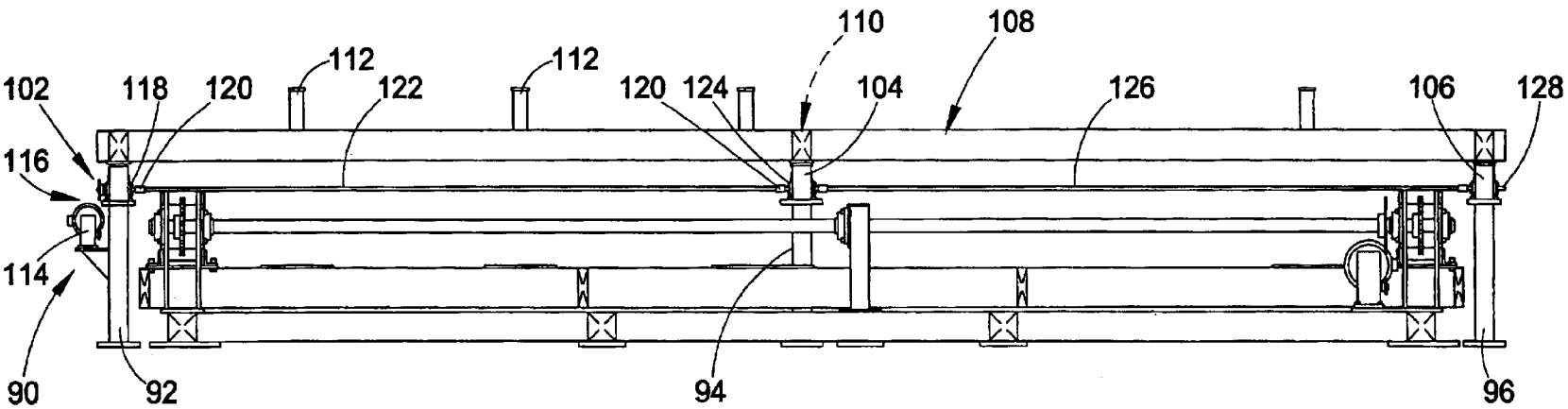
FIG. 7 is a side view of a link stop mechanism in accordance with the present invention.

With continued reference to FIGS. 1–6 and additional reference to FIGS. 6*a* and 7, the bundling apparatus 10 additionally includes a freestanding motorized adjustable link stop mechanism 90. The link stop mechanism 90 includes a plurality of tubular vertical support frames 92, 94 and 96. Support frames 92–96 (FIG. 6*a*) include tubular guides 98 disposed telescopically within support frames 92–96. The guides 98 each support a member mounting plate 100 in a level position and allow only vertical movement. Each frame 92–96 additionally includes a screw jack 102,104,106, a scissor jack, or other suitable and convenient means for raising and lowering respective mounting plates 100. Longitudinal members 108 are mounted across all of the mounting plates 100 with supporting cross members 110 disposed therebetween. A plurality of link stops 112 are mounted to the longitudinal members 108 in line with the link members 86 that between each set of opposing link arms. Link stops 112 consist of two vertical square posts 112*a* and a connecting cross plate 112*b*.

With specific reference now to FIG. 7, a motorized system is disposed to move screw jacks 102–106 up or down in unison. The system includes a motor 114 mounted to the vertical support frame 92 that is located near one end of frame 14. The motor 114 is connected by a chain and sprocket means 116 to one end of an input shaft 118 of screw jack 102. At an opposite end, input shaft 118 has a coupling 120 connected to one end of connecting shaft 122. At an opposite end, connecting shaft 122 has another coupling 120 connected to a second input shaft 124, that of screw jack 104. Likewise, input shaft 124 has, at an opposite end, a coupling 120 connected to yet another connecting shaft 126 which connects to input shaft 128 of jack 106 via another coupling 120.

With reference back to FIGS. 1–6, drive trucks 22 and 26 and idle trucks 24 and 28 are positioned away from one another near the distal ends of truck beams 18 and 20 in an unbundled or first operative position (FIG. 1). Such positioning also causes opposing link arms 82 and 84 to separate to a position whereby each set of link members 86 is stretched out under tension (see also FIG. 6) and in a position preferably nearly parallel to the truck beams 18 and 20. The tension created on the set of link members 86 prevents individual link members 88 from pivoting with respect to one another. In this position, the members 88 unitarily act as a single, taught member.

Figure 8A:
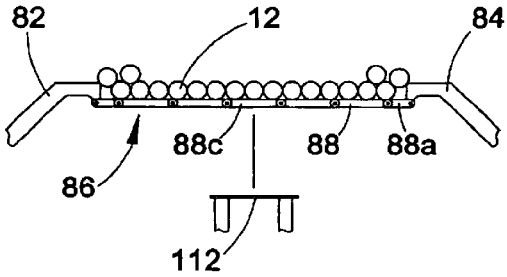
FIGS. 8*a*–8*f* diagrammatically illustrate a set of links formed in accordance with the present invention and use of same in accordance with the method of the present invention to form a bundle of associated objects.
Figure 8B:
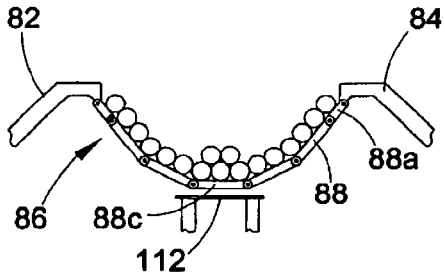
Figure 8C:
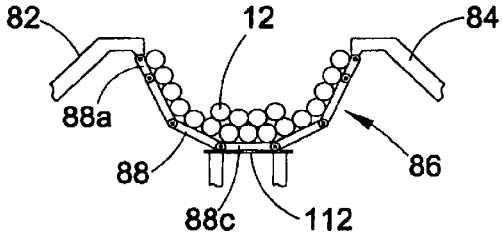
Figure 8D:
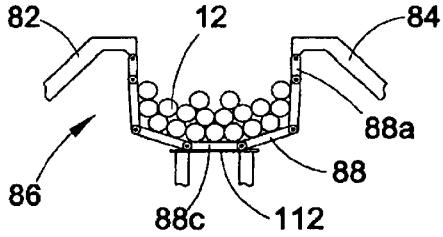
Figure 8E:
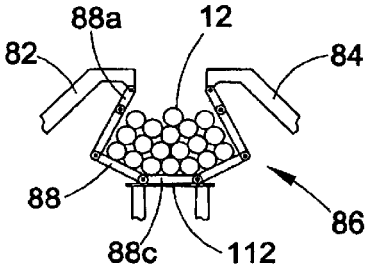

Operation of the subject apparatus in accordance with the present invention can be best understood with reference also to FIGS. 8*a*–8*f*. Operation begins with the apparatus unloaded and in the unbundled first position (FIG. 1) with each set of link members 86 in a stretched-out position and link stops 112 set to a select height. The associated bundling material 12 is then loaded onto the one or more sets of link members 86 (FIG. 8*a*). The individual objects of the bundling material 12 are generally loaded onto the link members 88 in a single layer or nearly a single layer. Also, the number of objects of the material to be bundled 12 that is placed on the link sets 86 is controlled and equals the number of objects desired in the resulting bundle.

Figure 8F:
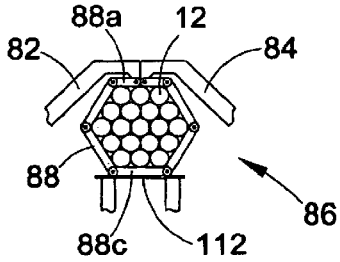

After a select, predetermined amount of the bundling material 12 is loaded onto the link members 88 as described, the motor 40 is used to turn drive sprockets 44 and 46 which move drive trucks 22 and 26 and idle trucks 24 and 28 toward one another eventually to the second bundled position (FIGS. 2 and 8*f*). As shown in FIGS. 8*a*–8*f*, the action of the drive trucks 22–28 causes the plurality of opposing link arms 82 and 84 to simultaneously move toward one another as shown in FIGS. 8*b*–8*e* which eases the tension in each set of link members 86. This motion of the link arms can be continuous and/or intermittent. As the tension eases, the bundling material 12 begins falling, rolling, or otherwise shifting toward the central link member 88*c* of each set of link members 88. Also, link members 88 pivot relative to one another with the central link members 88*c* moving vertically downward until coming to rest on link stops 112. The opposing link arms 82 and 84 continue advancing toward one another until stop blocks extending from the underside of link arms 82 and 84 contact one another or until otherwise halted. Those of ordinary skill in the art will recognize that the height of the link stops can be controlled during the bundle forming process to support the links at any stage of the process and/or to shift the bundling material and help form the load. Once the link arms are moved together as described, the link members 88 form a hexagon shape out of the bundling material 12 which may be banded or otherwise secured for removal from the apparatus.

Those of ordinary skill in the art will recognize that the secondary or end links 88*a* of the link set 86, in the second or bundled position, move into alignment and combine to form a link member that has a length identical or nearly so to the primary links 88. While this arrangement is preferred, the secondary links 88*a* can be replaced with a single link. It is also contemplated that the secondary links 88*a* be removed altogether, so that in the second operative position, the material 12 is moved into a bundle shape having N sides or flats using only N−1 links, with a horizontal top flat simply held in position by gravity until the material is banded.

In the illustrated embodiment, a polygonal bundle having N flats is formed using one or more sets 86 of links comprising N−2 primary links and two secondary links. As noted, the same bundle could be formed using one or more sets of links comprising N primary links 88 or merely N−1 primary links 88. Of course, the length of the links controls the resulting length of the flats on the bundle. While it is generally preferred to form symmetrical bundles having equal length sides, the length of the links 88 can be varied within a set 86 of links to vary the length of the flats.

Figure 9:
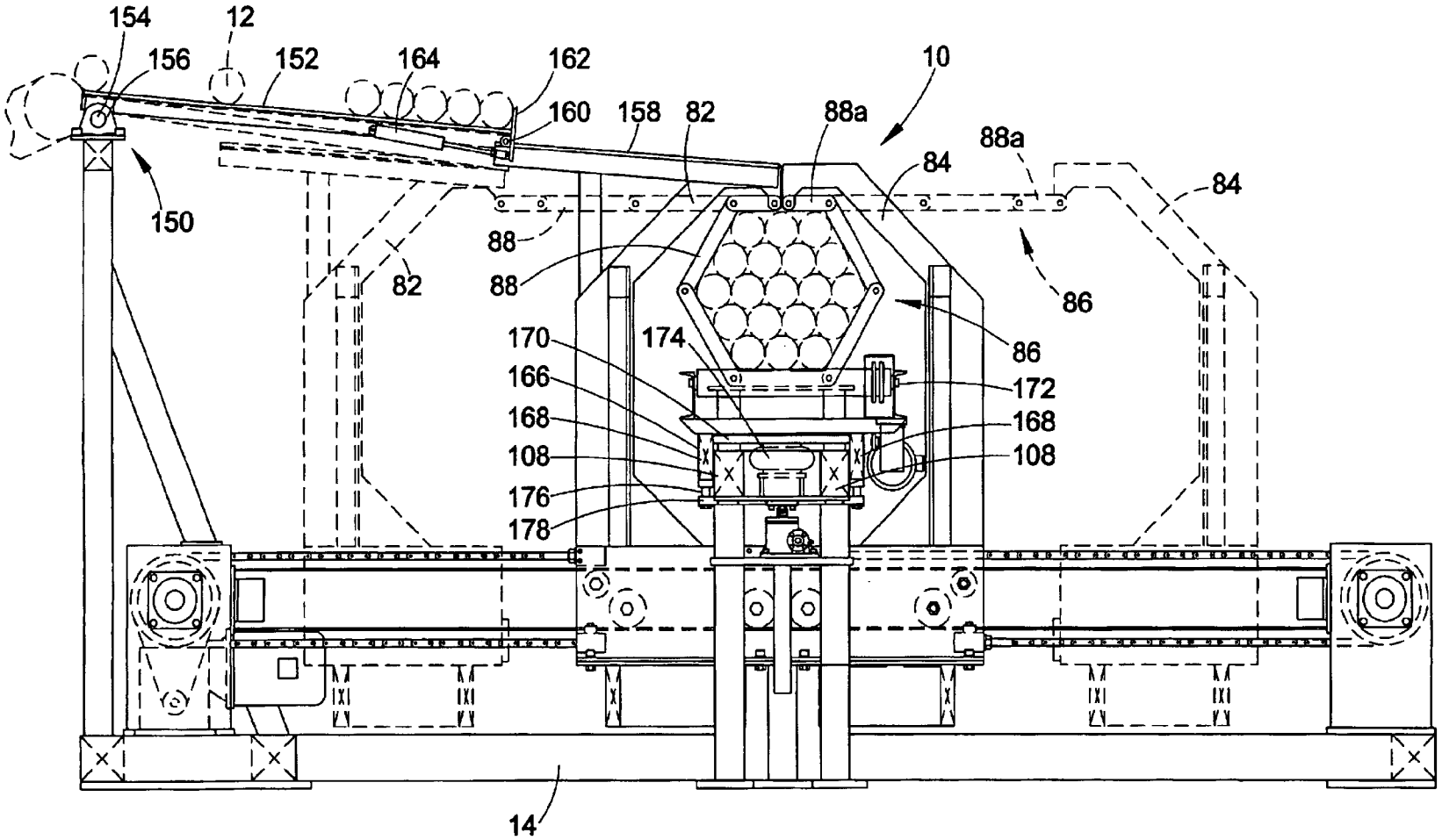
FIG. 9 is an end view of a bundler apparatus and a loading and unloading apparatus operatively connected to the bundler apparatus in accordance with the present invention.

With reference to FIG. 9, the apparatus 10 additionally includes an optional loading apparatus 150 attached to frame 14. Loading apparatus 150 includes a first ramp 152 pivotally attached by a shaft 154 and bearings 156. The loading apparatus 150 also includes a second ramp 158 securely mounted to drive side link arms 82. First ramp 154 is movably secured to second ramp 158 by means of rollers 160. Additionally, a stop plate 162 is disposed between the ramps 152 and 158 to adjustably control the loading process. Stop plate 162 is toggled between an open and closed position by a cylinder 164 or other like means. When stop plate 162 is in a closed position, bundling material 112 cannot be loaded onto the sets of link members 86 from the first ramp 152.

Additionally, a conveyor support frame 166 rests on the longitudinal members 108. The support frame 166 includes a pair of length members 168 disposed along the entire length of the longitudinal members 108 and cross members 170 extending therebetween. The support frame 166 supportably secures a conventional conveyor 172 along its length for removing bundling material 12 from the apparatus 10 upon bundling. The entire support frame 166 is capable of being raised and lowered by means of multiple air bag type cylinders 174 or the like. The raising and lowering of the support frame 166 is guided by a plurality of large diameter shoulder bolts 176 which are connected to the support frame 166 and mounting plates 178.

In loading the apparatus 10, cylindrical objects or other bundling materials 12 are loaded onto the first ramp 152 through any known means. The individual objects of bundling material 12 are allowed to roll down the first ramp 152 until reaching the stop plate 162 which is initially set in the up position. With the apparatus 10 in the unloaded position (links 88 stretched), the stop plate 162 is lowered allowing bundling material 12 to roll down the second ramp 150 onto the stretched links 88 which are acting as a single, taught member as described above.

With the bundling material 12 loaded onto the links 88, the apparatus 10 operates in the manner described above to form a bundle which may then be banded for removal from the apparatus. From the bundled position, the link arms 82 and 84 are moved outwardly away from one another to an intermediate position to relax the hold on the banded bundling material 12 but not far enough for the links 88 to lift the bundling material 12. The air bag cylinders 174 are then operated to raise the powered conveyor 172 which, in turn, raises the bundling material 12 off of links 88. The conveyor 172 is then activated to move the bundled material 12 longitudinally off of the bundling apparatus 10 for further handling. After the bundling material 12 is clear of the apparatus 10, the powered conveyor 172 is stopped and lowered by releasing the air pressure from the air bag cylinders 174.

Figure 10A:
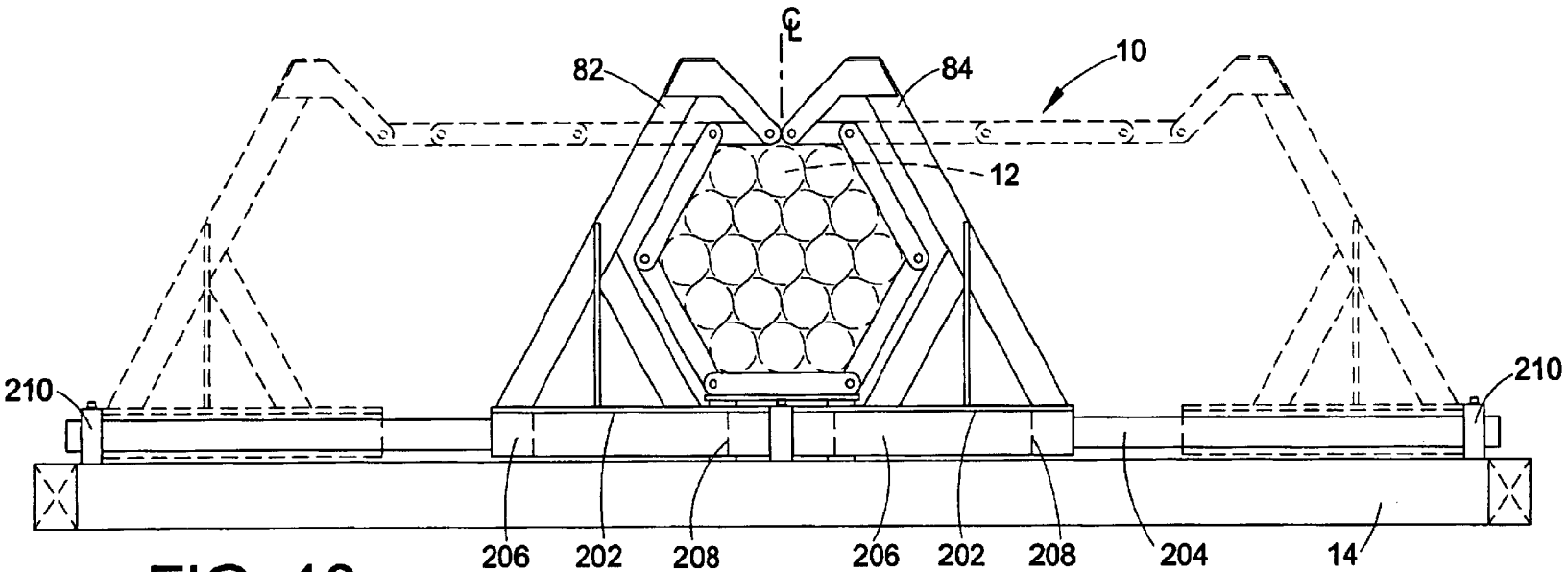
FIG. 10*a* is a sectional view taken along line A—A of FIG. 11 and shows a bundling apparatus formed in accordance with a second preferred embodiment.
Figure 10B:
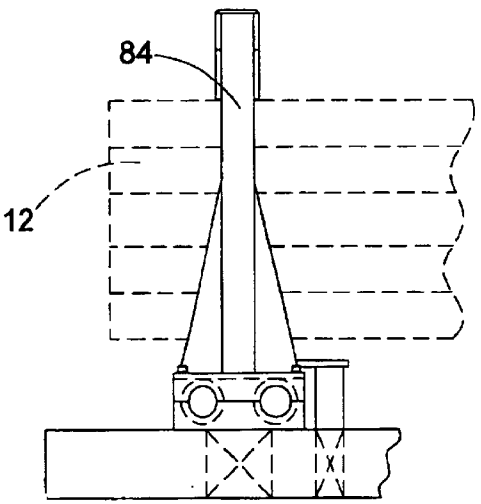
FIG. 10*b* is a partial side of the apparatus of FIG. 10*a;*
Figure 11:
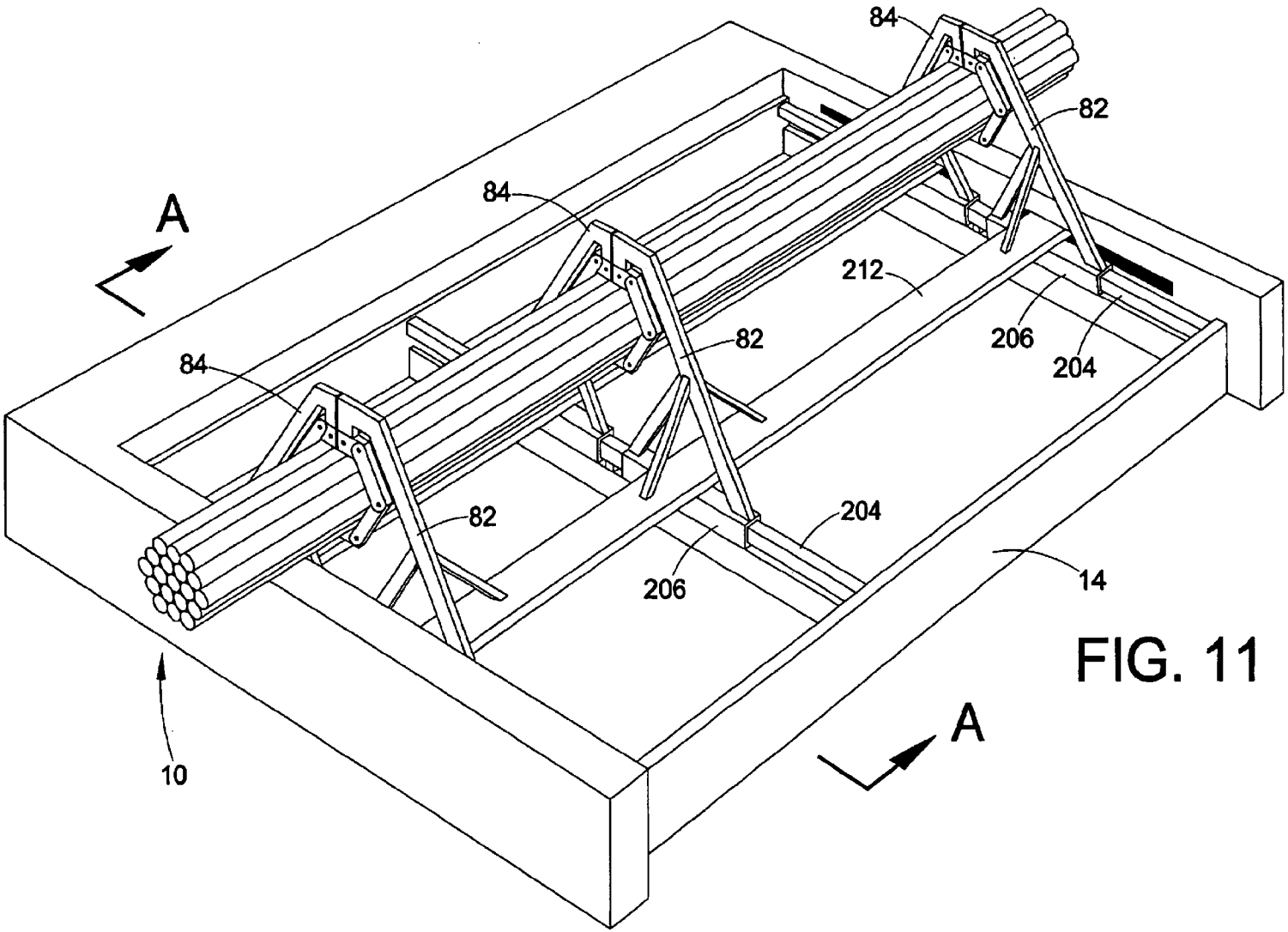
FIG. 11 is a perspective view of a bundler apparatus in accordance with the second preferred embodiment of the present invention.

With reference to FIGS. 10*a*–10*b* and 11, a second preferred embodiment of the bundling apparatus 10 is shown. In this embodiment, link arms 82 and 84 are mounted to support plates 202 which are slidably mounted to transverse members 204 by tubes 206. More specifically, tubes 206 include bushings 208 for slidably engaging transverse members 204. The transverse members 204 are positioned perpendicular to bundling material 12 and are mounted to frame 14 by a plurality of mounting blocks 210. Longitudinal members 212 continue to connect the plurality of link arms 82 to one another and likewise with the plurality of link arms 84. The operation is the same as described in the first preferred embodiment except the link arms 82 and 84 are moved via tubes, rather than trucks.

Figure 12B:
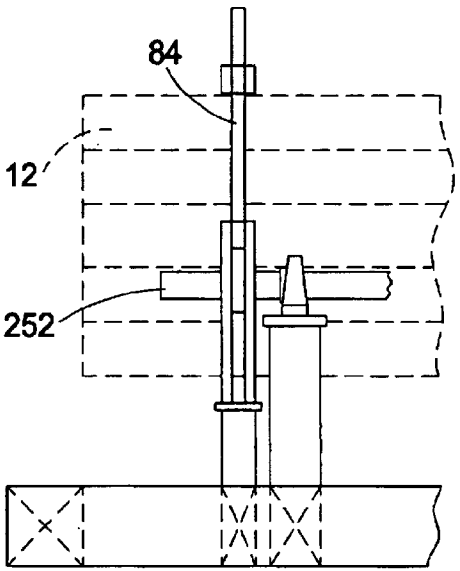
FIG. 12*b* is a side view of the apparatus of FIG. 12*a*.
Figure 12A:
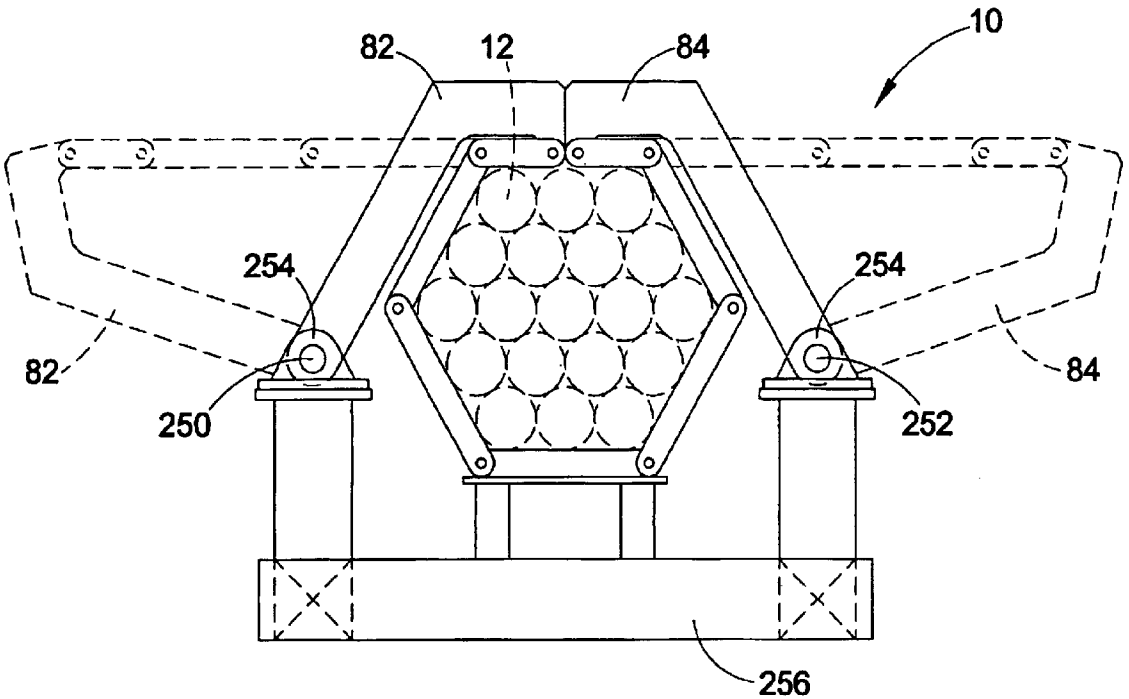
FIG. 12*a* is a cross-sectional view of a bundler apparatus in accordance with a third preferred embodiment of the present invention.

With reference to FIGS. 12*a* and 12*b*, a third preferred embodiment of the bundling apparatus 10 is shown. In this embodiment, a rotating action is applied to the links arms 82 and 84 to form and hold a bundle of cylindrical objects 12. The link arms 82 and 84 are rotatably mounted to counter-rotating shafts 250 and 252. The shafts 250 and 252 are supported on pillow block bearings 254 which are mounted to a frame 256. The operation is the same as described in the first preferred embodiment except the link arms 82 and 84 are moved via counter-rotating shafts 250 and 252, rather than trucks.

The invention has been described with reference to the preferred embodiments. Obviously, modifications and alterations will occur to others upon reading and understanding the preceding detailed description. It is intended that the invention be construed as including all such modifications and alterations insofar as they are within the scope of the appended claims or the equivalents thereof.

Having thus described the preferred embodiments, the invention is now claimed to be:

1. An apparatus for forming a plurality of associated elongated objects into a polygonal bundle, said apparatus comprising:

at least one set of link members defined by a plurality of link members rotatably interconnected to each other in an end-to-end relationship, said at least one set including first and second opposite ends;

a first support arm pivotally connected to the first end of said at least one set of link members;

a second support arm pivotally connected to the second end of said at least one set of link members, wherein at least one of said first and second support arms is movable toward and away from the other of said first and second support arms so that said first and second support arms are movable to and between:

(i) a first operative position wherein said at least one set of link members is elongated and said first and second opposite ends thereof are spaced apart; and, (ii) a second operative position wherein said at least one set of link members defines a predetermined select polygonal shape and said first and second opposite ends are moved adjacent each other, with each of said link members defining a flat portion of said polygonal shape.

2. The apparatus as set forth in claim 1, wherein said first and second support arms are each movably supported on a frame and adapted for pivotally movement on an arc toward and away from each other.

3. The apparatus as set forth in claim 1, wherein said at least one set of link members comprises at least two parallel and spaced-apart sets of link members.

4. An apparatus for forming a plurality of associated elongated objects into a polygonal bundle, said apparatus comprising:

at least one set of link members defined by a plurality of link members pivotally interconnected in an end-to-end relationship, said at least one set including first and second opposite ends;

a first support arm pivotally connected to the first end of said at least one set of link members;

a second support arm pivotally connected to the second end of said at least one set of link members, wherein at least one of said first and second support arms is movable toward and away from the other of said first and second support arms so that said first and second support arms are movable to and between:

(i) a first operative positions wherein said at least one set of link members is elongated and said first and second opposite ends thereof are spaced apart; and, (ii) a second operative position wherein said at least one set of link members defines a polygonal shape and said first and second opposite ends are moved adjacent each other, wherein said first and second support arms are each movably supported on a frame and adapted for linear movement toward and away from the other of said first and second support arms.

5. An apparatus for forming a plurality of associated elongated objects into a polygonal bundle, said apparatus comprising:

at least one set of link members defined by a plurality of link members pivotally interconnected in an end-to-end relationship, said at least one set including first and second opposite ends;

a first support arm pivotally connected to the first end of said at least one set of link members;

a second support arm pivotally connected to the second end of said at least one set of link members, wherein at least one of said first and second support arms is movable toward and away from the other of said first and second support arms so that said first and second support arms are movable to and between:

(i) a first operative positions wherein said at least one set of link members is elongated and said first and second opposite ends thereof are spaced apart; and, (ii) a second operative position wherein said at least one set of link members defines a polygonal shape and said first and second opposite ends are moved adjacent each other, wherein said at least one set of link members comprises:

a plurality of primary link members each having a primary length; and, first and second secondary link members each having a length less than said primary length, wherein said first secondary link member is pivotally connected at a first end to said first support arm and pivotally connected at a second end to an adjacent one of said primary link members, and wherein said second secondary link member is pivotally connected at a first end to said second support arm and pivotally connected at a second end to an adjacent one of said primary link members.

6. The apparatus as set forth in claim 5, wherein said length of each of said secondary link members is not more than half the primary length.

7. The apparatus as set forth in claim 5, further comprising a link stop assembly located vertically beneath said at least one set of link members, said link stop assembly including a support member for supporting one of said plurality of link members when said support arms are in said second operative position.

8. The apparatus as set forth in claim 7, wherein said support member is adjustable vertically toward and away from said at least one set of link members.

9. The apparatus as set forth in claim 8, further comprising:

a conveyor located adjacent said at least one set of link members and movable into select engagement with an associated bundle of said elongated objects supported on said at least one set of link members.

10. A bundler apparatus for producing a bundle from a plurality of elongated objects, the apparatus comprising:

a frame;

a set of beams disposed parallel to one another and extending from one side of said frame to an opposite side of said frame;

a first truck and a second truck slidably disposed on each of said beams, said first truck and said second truck having first and second opposed link arms mounted respectively thereto;

a set of link members operatively connected said first and second link arms, the set of link members rotatably connected to one another in end-to-end arrangement;

a drive system adapted for selectively advancing said first and second link arms from a first operative position, where said first and second link arms are spaced apart and said set of link members is out-stretched, toward one another into a second operative position where said first and second link arms are adjacent and wherein said set of link members define a predetermined polygonal bundled shape.

* * * * *